US010973307B1

(12) United States Patent
Tsanev et al.

(10) Patent No.: US 10,973,307 B1
(45) Date of Patent: Apr. 13, 2021

(54) FOLDABLE FRAME FOR HAMMOCK SWING

(71) Applicants: Tihomir Tsanev, Arlingotn Heights, IL (US); Detelina T. Tsaneva, Ruse (BG)

(72) Inventors: Tihomir Tsanev, Arlingotn Heights, IL (US); Detelina T. Tsaneva, Ruse (BG)

( * ) Notice: Subject to any disclaimer, the term of this patent is extended or adjusted under 35 U.S.C. 154(b) by 0 days.

(21) Appl. No.: 16/592,027

(22) Filed: Oct. 3, 2019

(51) Int. Cl.
*A45F 3/24* (2006.01)

(52) U.S. Cl.
CPC ..... *A45F 3/24* (2013.01)

(58) Field of Classification Search
CPC . A45F 3/24; E05C 19/10; E05C 19/12; E05C 19/14; E05C 19/145
See application file for complete search history.

(56) References Cited

U.S. PATENT DOCUMENTS 5,636,392 A * 6/1997 Choi ..... A45F 3/24 24/72.5
10,441,060 B1 * 10/2019 Pinholster, Jr. ..... A47C 9/105

* cited by examiner

*Primary Examiner* — David R Hare
*Assistant Examiner* — Adam C Ortiz

(57) ABSTRACT

A foldable hammock frame comprising two elongate support members hinged at opposite ends. Between the two ends of said elongate support members a conventional hammock can be diploid. The frame designed with the curvature of the two support members allowing the foldable hammock frame to stand in multiple stable positions that provide comfort for the user.

Hinges allow the frame to be folded and are equipped with an angle limiter that limits the angle of the hinge opening in unfolded position. The foldable hammock frame has a locking mechanism and can be locked in unfolded position preventing accidental folding while in use.

3 Claims, 7 Drawing Sheets

FOLDABLE FRAME FOR HAMMOCK SWING

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is related to hammock assembly and specifically to a hammock supporting frame assembly for conventional hammock. Further, this invention is related to a foldable hammock supporting frame assembly that can support a hammock in multiple reclining positions.

2. Description of the Related Art

Different hammock supporting frames are known. For example, patent application US2016/0106200 A1 is showing a frame that has two curved elongate support members bolted together at opposite ends under acute angle. Each elongate element made of several sections and can be taken apart.

Although the prior art has numerous reclining positions that allow the hammock to move back and forth, the circular arc shape of the two elongate support members is such that the frame tend to be hard to balance by the user and too easily leans one way or the other. The shape of the curved members can be improved to limit the rocking motion of the swing and thus increase the comfort for the user.

While portability is an essential part of the prior art, it is usually achieved by taking apart the hammock frame which is very time consuming and inconvenient for the user. Foldable models (e.g. U.S. Pat. No. 337,792A) are complicated, costly to manufacture, and heavy or hard and time=consuming to fold by the user.

SUMMARY OF THE INVENTION

The purpose of the current invention is a stable and foldable supporting frame for hammock providing comfort for the user. The Foldable hammock frame has sturdy structure and is easy to (operate) fold and unfold by the user. In folded position the frame can be easily moved, transported or stored in any contemporary home.

In the preferred embodiment the current invention has two elongate support members hinged together at opposite ends. Each support member comprises consecutively connected curved sections with different radiuses of the curvature, with the curvature of the two support members being equal.

The Folding hammock frame can be folded when said second elongate member that is hinged to the said first elongate member can be moved so that the central parts of both elongate support members can be moved close to each other.

Hammock attachment members are attached to both hinges located at each of the opposite ends so that a hammock can be deployed between the two opposite ends. The hammock is free to rotate to tilted positions dependent upon an occupant's center of gravity relative to the hammock frame wherein the hammock frame will support the occupant in stable reclining and multiple stable sitting positions as well as in multiple stable positions in which an occupant will be inclined relative to horizontal and vertical planes.

Said two support members hinged together at the opposite ends lie in parallel planes relative to each other (1) when the frame is folded. (2) When the frame is unfolded the two support members lie in transverse planes at an acute angle relative to each other. The measurement of the acute angle is determined by an Angle limiter. Both hinges have the same design.

Angle limiter is used to limit separation of the opposite support members when the frame is unfolded holding the hammock at a preset distance from the ground level. Thus the invention enables the ease of operation and the elimination of additional elements such as lateral support strap (used in US2016/0106200 A1-FIG. 1).

The Folding hammock frame also has a fixing mechanism that prevents the frame from accidentally folding during usage. The foldable frame for hammock swing can be folded when the fixing mechanism is disengaged.

DETAILED DESCRIPTION OF THE INVENTION

Figure 1:
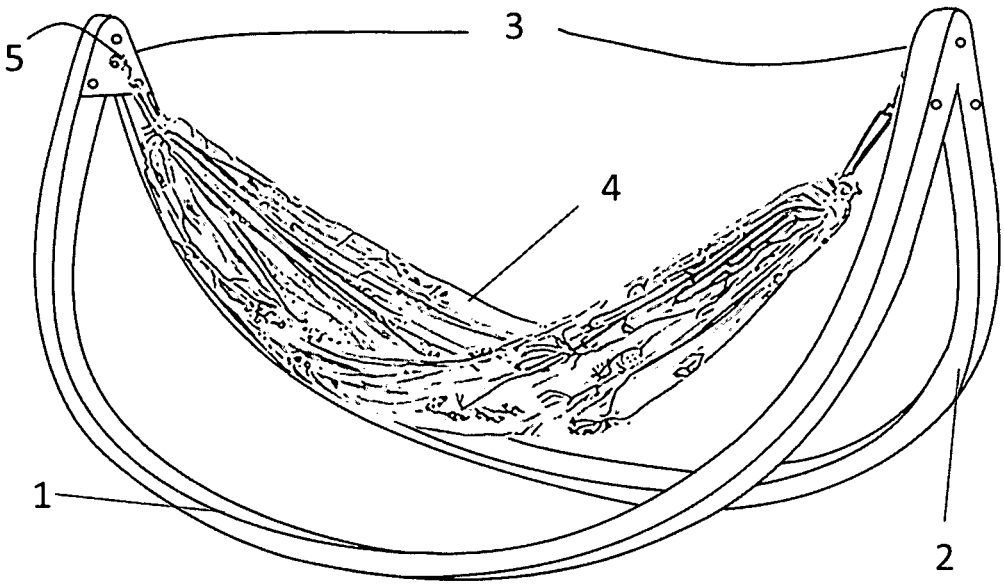
FIG. 1 is a three dimensional view of the foldable frame for hammock swing with attached hammock in unfolded position
Figure 2:
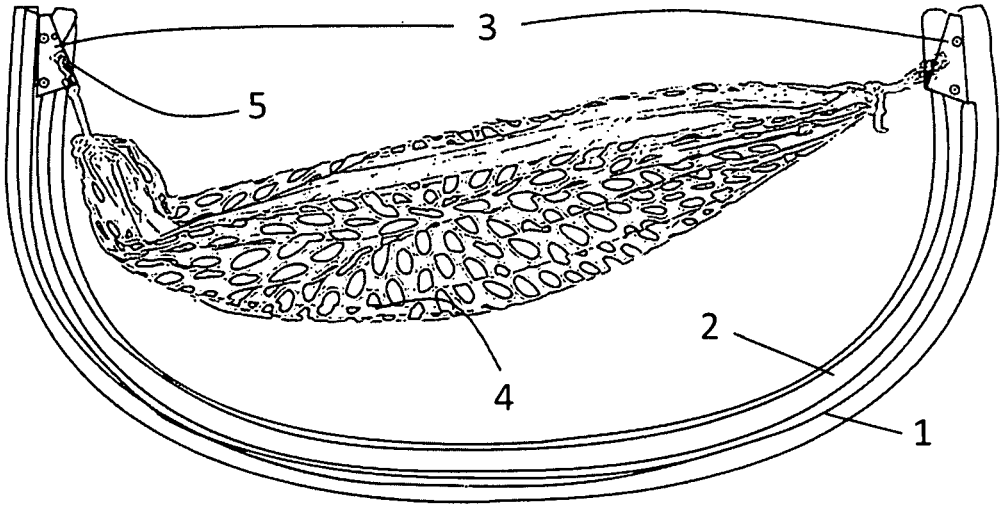
FIG. 2 is a three dimensional view of the foldable frame for hammock swing with attached hammock in folded position
Figure 3:
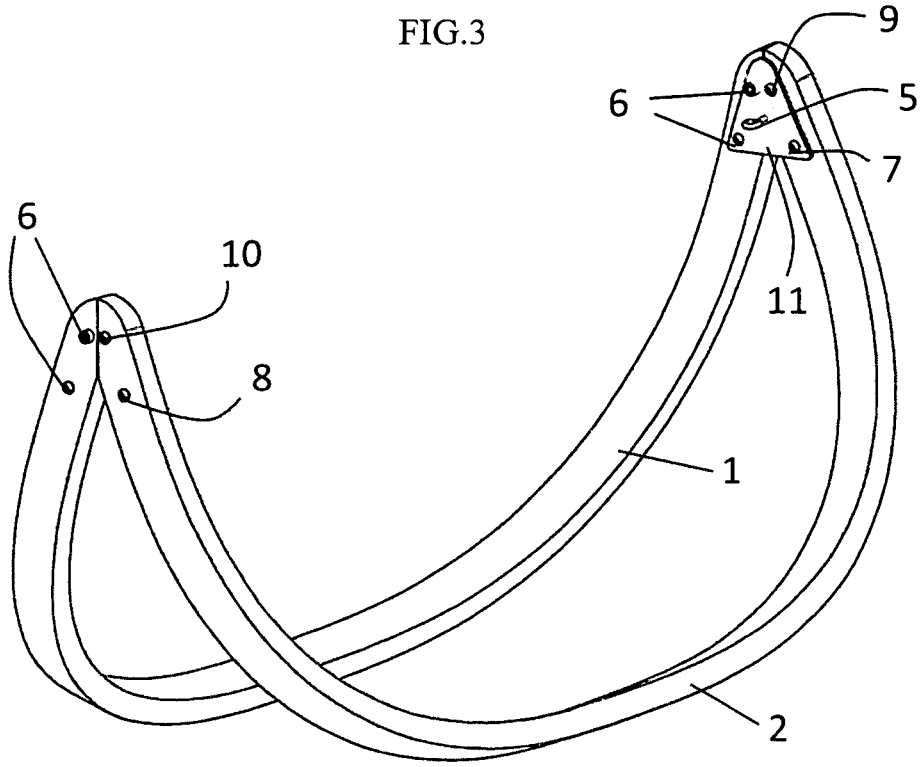
FIG. 3 is a three dimensional view of the assembled frame for hammock swing FIG. 4 End view of the assembled frame for hammock swing with attached hammock in unfolded position FIG. 5 End outside view of the foldable frame for hammock swing and the hinge connecting the two support members in folded position FIG. 6 Outside view of the opened hinge connecting the two support members in opened position FIG. 7 Side view of the hinge connecting the two support members with comprising elements FIG. 8 inside view of the hinge connecting the two support members in open position FIG. 9 Inside view of the hinge connecting the two support members in closed position FIG. 10 Outside view of the hinge connecting the two support members in open position in another embodiment FIG. 11 Outside view of the hinge connecting the two support members in closed position in another embodiment FIG. 12 Inside view of the hinge connecting the two support members in open position in another embodiment FIG. 13 Inside view of the hinge connecting the two support members in closed position
Figure 4:
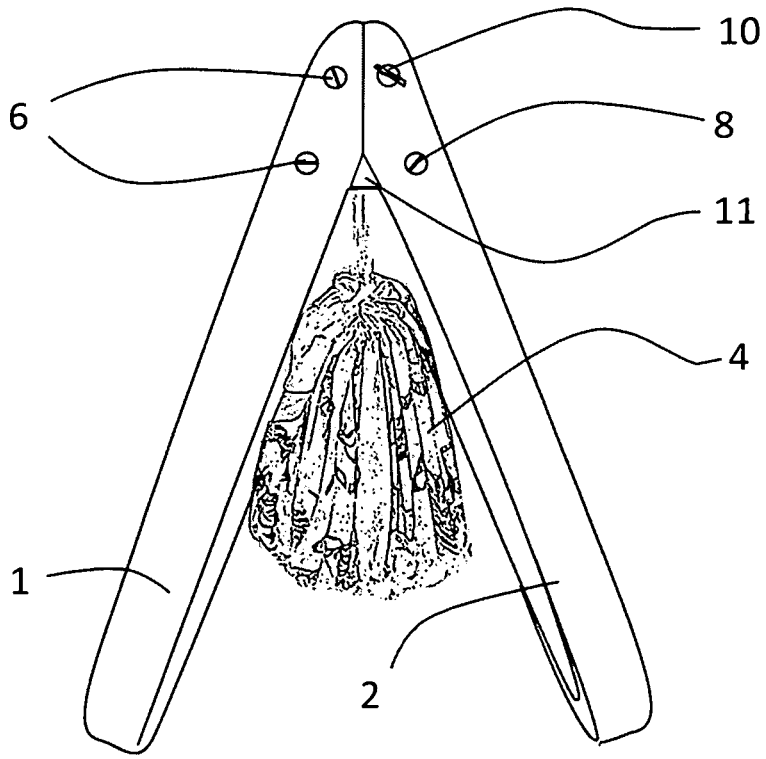
Figure 5:
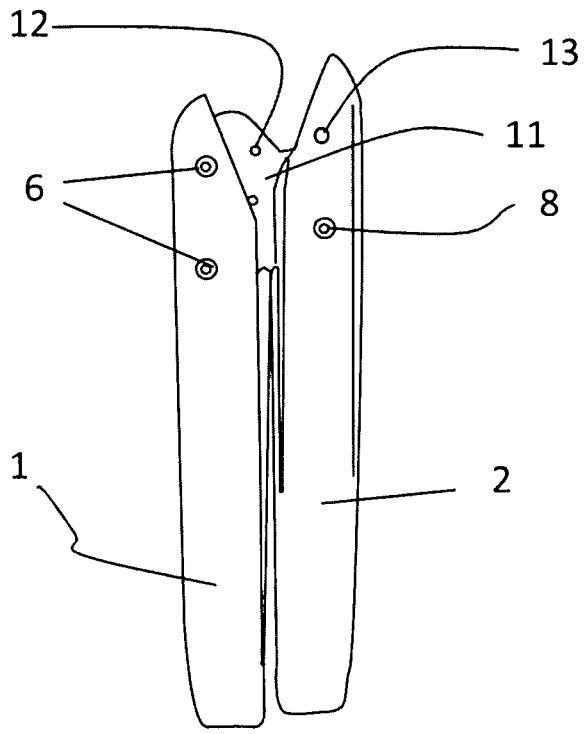

FIG. 1 shows a Foldable frame for hammock swing in unfolded position with attached conventional hammock 4.

Said foldable frame for hammock swing comprises two elongate support members 1 and 2, two hinges 3 connecting both ends of the two elongate support members 1 and 2 and two hammock attachment members 5 attached to hinges 3.

In the preferred embodiment elongate support member 1 and elongate support member 2 are identical made of solid wood with rectangular cross-section. In other embodiments, elongate support members 1 and 2 can be made of metal, plastic or other material with ellipse, tubular or other cross sections.

In the preferred embodiment said FFHS has two identical hinges 3. Each hinge 3 (FIG. 5, 6, 7, 8, 9) has a metal plate 11 with four openings, two bolts 6, additional bolt 7 with nut 8, and a fixing mechanism comprising fixing bolt 9 and nut 10. Metal plate 11 is fixed with two bolts 6 to the first elongate support member 1. Said first elongate support member 1 is fixed and cannot be moved in relation to the metal plate 11. The second support member 2 is bolted with bolt 7 and nut 8 to the metal plate 11 and can rotate freely around said bold 7. Thus bolt 7 is a hinge pin working as an axis of rotation for the hinge 3 and allowing the second elongate support member 2 and metal plate 11 to pivot around bolt 7. Thus metal plate 11 and elongate support member 1 can move in relation to elongate support member 2 and the foldable frame for hammock swing can be folded and unfolded.

Part of each hinge 3 is a fixing mechanism comprising bolt 9 and nut 10 used to hold said hinge 3 in open position and thus prevent the foldable frame for hammock swing from folding when in unfolded position.

Other hinge designs can be used to connect the two elongate support members.

Angle limiter limits the hinge opening so that each hinge 3 has a limited rotation angle. Limited rotation angle of the hinge 3 limits the hinge opening and thus allows the FFHS to hold the hammock 4 at a predetermined distance from the ground.

Figure 6:
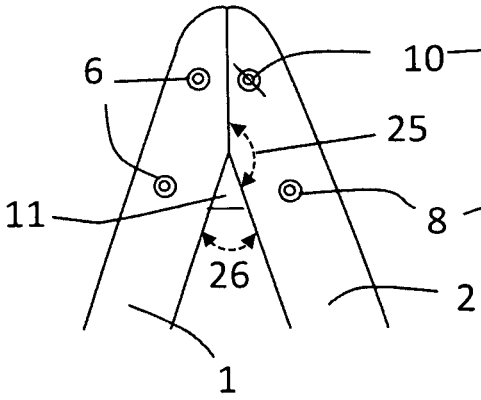

In the preferred embodiment, angle limiter is designed to allow the two elongate support members to diverge at a 40 degrees acute angle 26 (FIG. 6) when the frame is unfolded. In the preferred embodiment, angle limiter is built into each hinge and limits the angle by the shape of both ends of the elongate support members 1 and 2. FIG. 6 show that the end of elongate support member 1 is shaped under (160 degrees) an angle 25. The end of elongate support member 2 is shaped under the same 160 degree angle. Thus when hinge 3 is opened and the foldable frame for hammock swing unfolded, the beveled (under 160 degrees angle) ends of the elongate support members 1 and 2 meet to limit the hinge opening to a 40 degrees angle 26

Other angle limiter designs can be used to limit the hinge angle of rotation.

Each elongate support member 1 and 2 is U-sapped and has a curved section comprising ten (10) connected arcs with different curvature profiles (radiuses). U-shaped elongate support members 1 and 2 allow the foldable frame for hammock swing to stand in multiple reclining positions. In addition, curvature of the U-shaped curve is specially designed to optimize the rocking experience of the user and force the foldable frame for hammock swing to tend to stand centered touching the ground close to mid-point 22 (FIG. 14)

Figure 14:
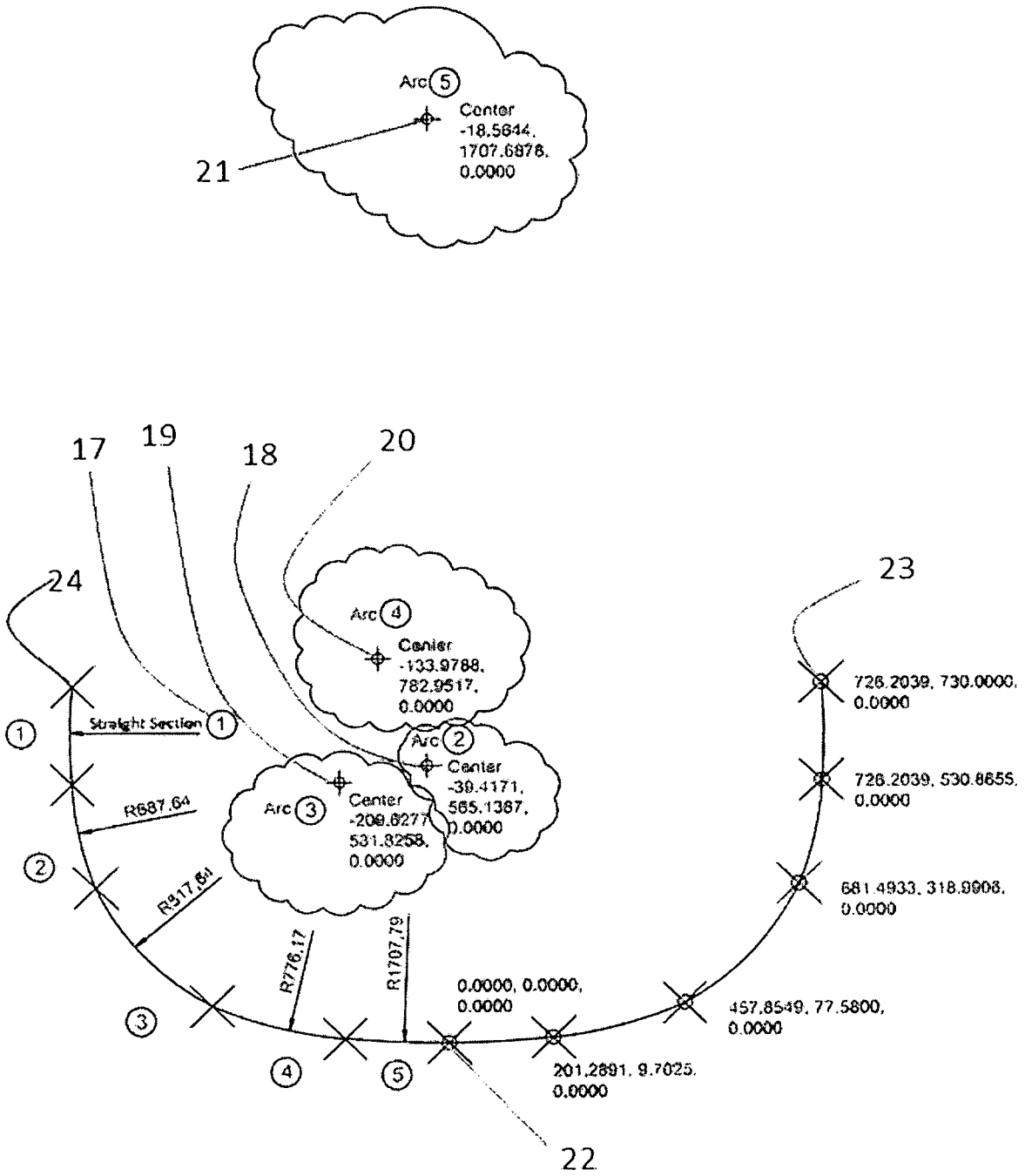
FIG. 14 represents the curvature of the inside edge of the elongate support member 1 drown in a coordinate system

FIG. 14 represents the curvature of the inside edge of the U-shaped elongate support member 1 drown in a coordinate plane (Cartesian coordinate system). The center of the coordinate plane coincides with the curvature mid-point 22 that has coordinates (0,0). The mid-point 22 is also part of the vertical Y-axis that splits the elongate support member curvature into two identical halves. Each half comprises one straight section connected with four connected arcs with different centers and radiuses. First half runs from said mid-pint 22 to end point 23 and comprises of the following five arcs:

The straight section 17 runs between two points with coordinates (726.2039, 730.0000) and (726.2039, 530.865)

The first arc has center 18 with coordinates (−39.4171, 565.1387) and radius 687.64 mm The second arc has center 19 with coordinates (−209.8277, 531.8258) and radius 517.64 mm The third arc has center 20 with coordinates (−133.9768, 782.9517) and radius 776.17 mm The fourth arc has center 21 with coordinates (−18.5644, 707.6878) and radius 1707.79 mm Fixing Mechanism is designed to hold the foldable frame for hammock swing in unfolded position and prevent accidental folding of the foldable frame for hammock swing when in use.

Figure 7:
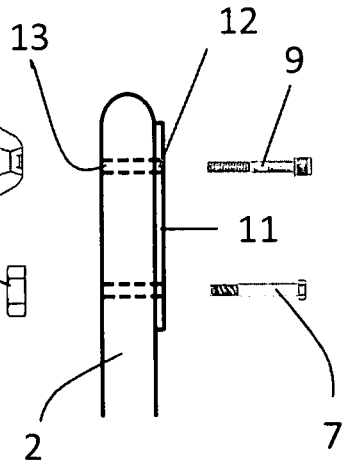
Figure 8:
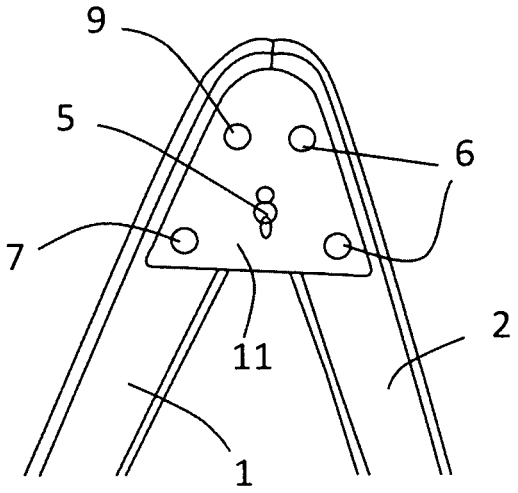
Figure 9:
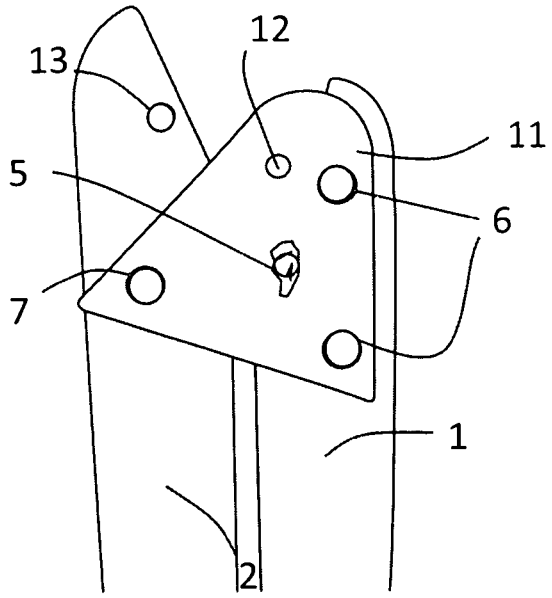
Figure 10:
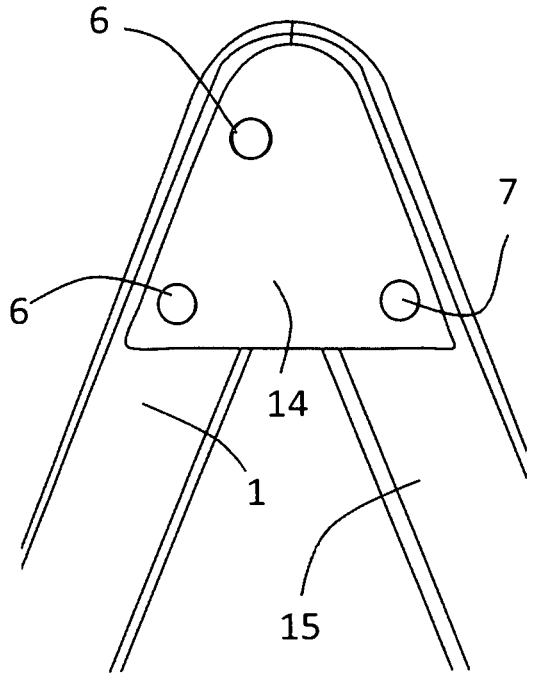
Figure 11:
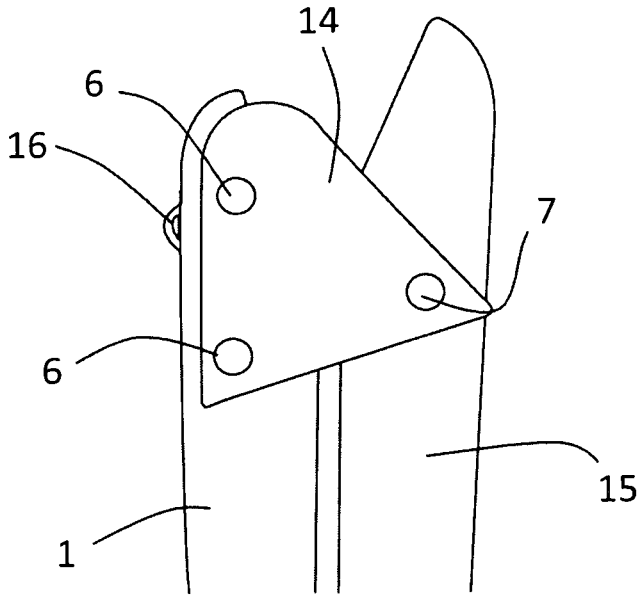

In the preferred embodiment fixing mechanism is part of each hinge 3 and comprises of a fixing bolt 9 (FIG. 7) that is inserted through additional openings 12 in the metal plate 11 and opening 13 in said second elongate support member 2. Nut 10 is used to hold fixing bolt 9 in position. In such unfolded position opening 12 in the metal plate 11 and opening 13 in the elongate support member 2 align and allow the fixing bolt 9 to be inserted holding the frame in open (unfolded) position. When the fixing bolt 9 is inserted in the two aligned openings 12 and 13 the fixing mechanism is engaged and the foldable frame for hammock swing cannot be folded. When said bolt 9 is removed from said aligned openings the fixing mechanism is disengaged and the foldable frame for hammock swing can be folded.

Figure 12:
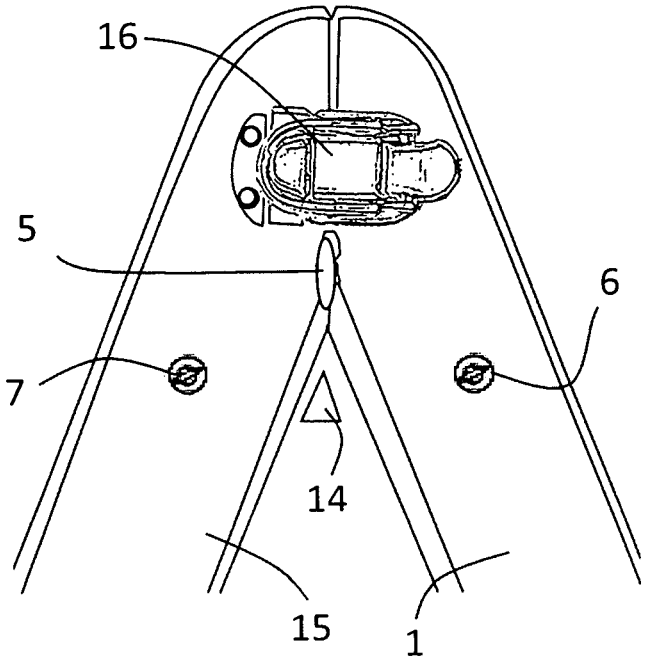
Figure 13:
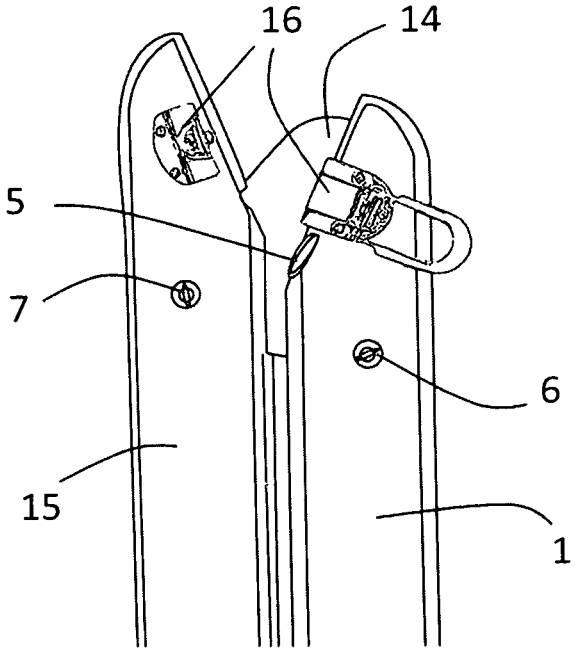

Other fixing mechanism designs can be used to hold the frame in unfolded position. In another embodiment (FIGS. 10, 11, 12 and 13) the fixing mechanism comprises of a two part latch 16 affixed to elongate support member 1 and 15. When the foldable frame for hammock swing is unfolded latch 16 can be engaged (FIG. 12) and thus prevent accidental folding of the FFHS while in use. In this embodiment metal plate 14 has only 3 openings and elongate support member 15 has the same shape as elongate support member 1. Elongate support member 15 has only one opening in each end for bolt 7. Thus bolt 7 is a hinge pin working as an axis of rotation for the hinge 3 and allowing the second elongate support member 15 and metal plate 14 to pivot around bolt 7. Thus metal plate 14 and elongate support member 1 can move in relation to elongate support member 15 and the foldable frame for hammock swing can be folded and unfolded.

In this embodiment Metal plate 14 is positioned on the outer side of elongate support members 1 and 15.

The invention claimed is:

1. A foldable hammock frame comprising two elongate support members hinged at opposite ends thereof, each elongate support member being U-shaped and includes a straight section at each of the opposite ends and at least three connected curved sections between the straight sections, with the curved section in the middle having the largest curvature radius; with the curvature of the two elongate support members being equal; the first elongate support member having two openings at each opposite end; the second elongate support member having one opening at each opposite end; two metal plates with triangular shape and rounded corners having three openings and being fixed to the first elongate support member at each opposite end with two bolts inserted into the two openings at each opposite end of the first elongate support member and also into the corresponding two openings in each metal plate; two hinge pins where the first hinge pin is inserted into the third opening in the first metal plate and also into the first opening in the second elongate support member, the second hinge pin inserted into the third opening of the second metal plate and also into the second opening in the second elongate support member and when the foldable hammock frame is in an open position, the two elongate support members are lying in transverse planes at an angle relative to each other; the hinge pins allow the two elongate support members to move in relation to each other so that a middle portion of the two elongate support members can be moved close to or apart from each other, and thus enabling the foldable hammock frame to fold and unfold; and a hammock attached to each metal plate and deployed between the two opposite ends of said elongate support members; an angle limiter comprising one end of each elongate support member; each end of the first elongate support member being shaped to contact one end of the second elongate support member when the foldable hammock frame opens and thus limit the foldable hammock frame opening to an acute angle.

2. The hammock frame of claim 1 further comprising a fixing mechanism that when engaged prevents the frame from folding.

3. The hammock frame of claim 1 wherein each of the elongate support members is made of wood.

* * * * *